US006945483B2

(12) United States Patent
Clifford et al.

(10) Patent No.: US 6,945,483 B2
(45) Date of Patent: Sep. 20, 2005

(54) ELECTROSTATIC PAINTING APPARATUS WITH PAINT FILLING STATION AND METHOD FOR OPERATING SAME

(75) Inventors: Scott J. Clifford, Rochester Hills, MI (US); Stan H. McClosky, Rochester Hills, MI (US); James S. Hager, Troy, MI (US); Ernest M. Otani, White Lake, MI (US); Gary J. Rutledge, Clarkston, MI (US); John C. Reinicke, Bloomfield Township, MI (US); Robert C. Foti, Fenton, MI (US)

(73) Assignee: Fanuc Robotics North America, Inc., Rochester Hills, MI (US)

( * ) Notice: Subject to any disclaimer, the term of this patent is extended or adjusted under 35 U.S.C. 154(b) by 283 days.

(21) Appl. No.: 10/004,936

(22) Filed: Dec. 5, 2001

(65) Prior Publication Data

US 2003/0042340 A1 Mar. 6, 2003

Related U.S. Application Data

(60) Provisional application No. 60/291,232, filed on May 16, 2001, and provisional application No. 60/251,686, filed on Dec. 7, 2000.

(51) Int. Cl.[7] ..... B05B 5/00; B05B 15/02; F23D 11/32

(52) U.S. Cl. ..... 239/690.1; 239/690; 239/112; 239/104; 239/106

(58) Field of Search ..... 239/690.1, 690, 239/112, 104, 106, 302–304, 352, 353, 436, 438, 443, 444, 549, 551, 562, DIG. 14; 141/129, 155, 156, 160, 375, 319, 237, 241

(56) References Cited

U.S. PATENT DOCUMENTS

| | | | | | |
|---|---|---|---|---|---|
| 3,825,043 | A | * | 7/1974 | Fechheimer | 141/147 |
| 3,831,850 | A | * | 8/1974 | Hunter | 239/144 |
| 3,949,791 | A | * | 4/1976 | Vadas | 141/5 |
| 4,051,805 | A | * | 10/1977 | Waldrum | 118/58 |
| 4,299,500 | A | * | 11/1981 | Bassetti | 366/198 |
| 4,313,475 | A | | 2/1982 | Wiggins | |
| 4,785,760 | A | | 11/1988 | Tholome | |
| 5,078,302 | A | * | 1/1992 | Hellenberg | 222/144 |
| 5,143,294 | A | * | 9/1992 | Lintvedt | 239/328 |
| 5,249,748 | A | | 10/1993 | Lacchia et al. | |
| 5,293,911 | A | * | 3/1994 | Akeel | 141/346 |
| 5,676,756 | A | * | 10/1997 | Murate et al. | 118/629 |
| 5,772,125 | A | | 6/1998 | Ehinger et al. | |
| 5,938,080 | A | * | 8/1999 | Haaser et al. | 222/144 |
| 6,039,092 | A | * | 3/2000 | Muscara | 141/129 |
| 6,179,217 | B1 | * | 1/2001 | Yoshida et al. | 239/7 |

FOREIGN PATENT DOCUMENTS

| | | |
|---|---|---|
| WO | WO 97/34707 | 9/1997 |
| WO | WO 98/51415 | 11/1998 |

* cited by examiner

*Primary Examiner*—Davis Hwu
(74) *Attorney, Agent, or Firm*—Butzel Long

(57) ABSTRACT

A waterborne paint bell applicator is movable to and from a docking position and includes a paint receptacle connected to a paint canister. A paint filling station has a plurality of paint injectors each connected to a different color paint supply and being movable to the docking position for engagement with the paint receptacle for filling the paint canister with paint. A servomotor drives a piston in the canister. A paint valve in each injector is prevented from opening when the bell applicator is not present at the docking position

31 Claims, 12 Drawing Sheets

| PROCESS STEP | DESCRIPTION | VALVE STATE | | | | | | | | | DOCKING POSITION | PISTON POSITION |
|---|---|---|---|---|---|---|---|---|---|---|---|---|
| | | 8 | 52 | 53 | 55 | 32 | 33 | 34 | 44 | 48 | | |
| A | FINISHED PAINTING GREEN | | | | | | | | | | REMOTE | AT BOTTOM |
| B | CLEAN PISTON FACE AND BELL CUP, INDEX INJECTOR | ON | ON | | ON | | ON | ON | ON | | REMOTE | OSCILLATE NEAR BOTTOM |
| C | DOCK WITH PAINT SUPPLY | | | | | | | | | | DOCKED | AT BOTTOM |
| D | PRIME LINES WITH RED PAINT | | | | | ON | | ON | ON | ON | DOCKED | AT BOTTOM |
| E | FILL CANISTER WITH RED PAINT | | | | | ON | | ON | | ON | DOCKED | RETRACTING |
| F | LEAVE DOCK & CLEAN INJECTOR | ON | ON | | ON | ON | ON | | | | NEAR | AT TOP |
| G | CLEAN CONTROL VALVE FACE | ON | ON | ON | | | | | | | REMOTE | AT TOP |
| H | PAINT WITH RED | | | | | | | | ON / OFF | | REMOTE | DISPENSE |

FIG. 9

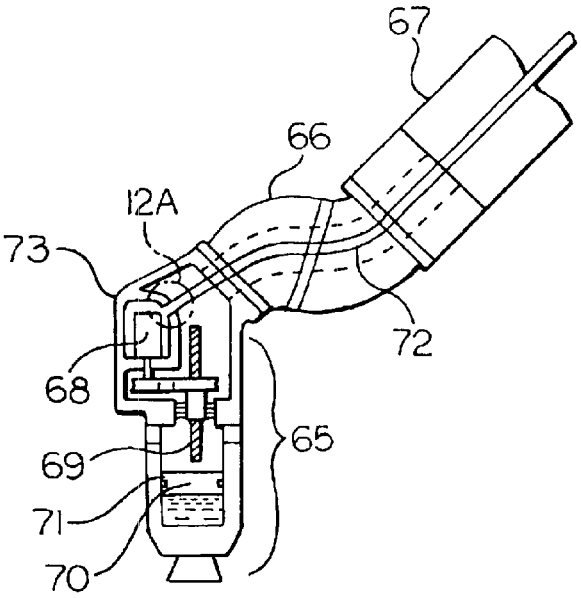
FIG. 12
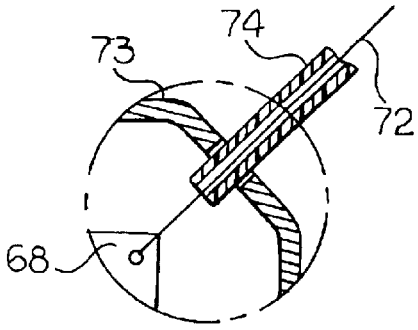
FIG. 12A
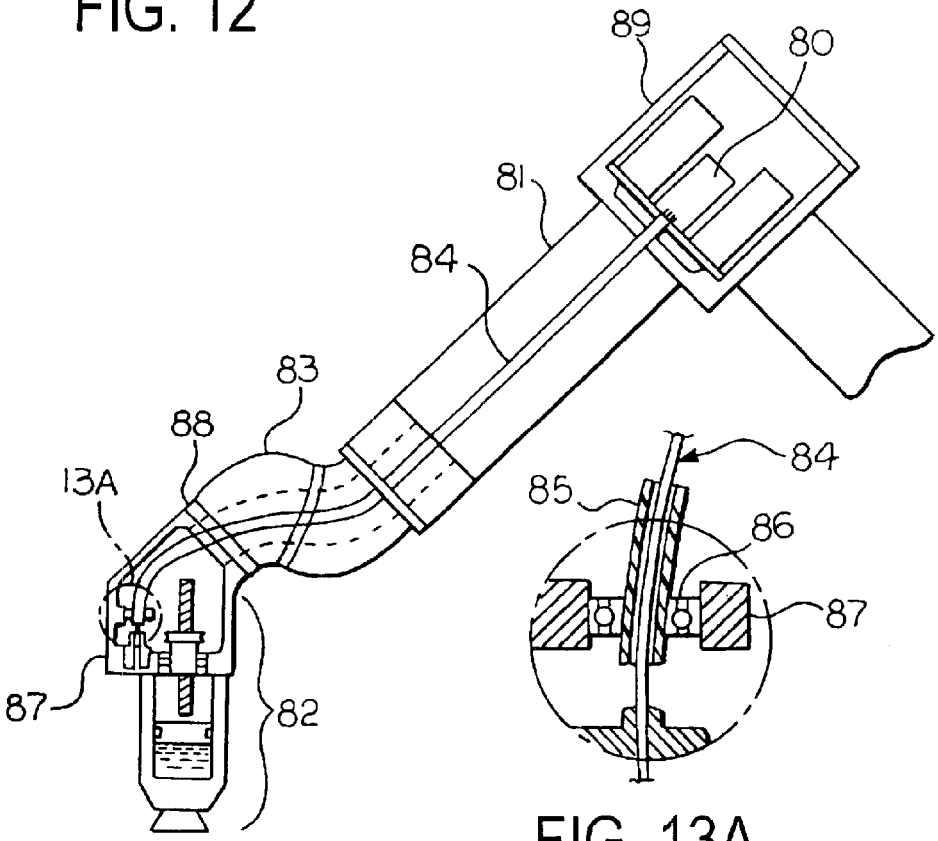
FIG. 13
FIG. 13A

FIG. 17

| PROCESS SEQUENCE - CHANGING COLOR | DOCKED | VALVE | | | | | | | | | | | |
|---|---|---|---|---|---|---|---|---|---|---|---|---|---|
| | | A | B | C | D | E | F | G | H | I | J | K | L |
| DONE PAINTING RED | NO | | | | | | | | | | | | |
| CLEAN PISTON FACE & INSIDE BELL CUP | NO | ON | ON | ON | | | | | | | ON | | |
| CLEAN OUTSIDE OF BELL | YES/NO | | | ON | | | | | ON | | ON | | |
| INDEX TO GREEN SUPPLY | YES/NO | VALVE POSITION N/A (CAN BE PARALLEL PROCESS) | | | | | | | | | | | |
| CLEAN SHROUD | YES | VALVE POSITION N/A (CAN BE PARALLEL PROCESS) | | | | | | | | | | | |
| PRIME LINES WITH GREEN | YES | ON | ON | | ON | | ON | | | | | ON | ON |
| FILL CAN WITH GREEN | YES | | ON | | ON | | ON | | | | | ON | ON |
| CLEAN & DRY DOCKING INTERFACE | YES | | | ON | ON | ON | | | | | ON | | ON |
| CONTINUE DRYING | NO | | | ON | ON | ON | | | | | ON | | |
| PAINT WITH GREEN | NO | ON | | | | | | | | | | | |

FIG. 18

| PROCESS SEQUENCE – REFILLING SAME COLOR | DOCKED | VALVE | | | | | | | | | | | |
|---|---|---|---|---|---|---|---|---|---|---|---|---|---|
| | | A | B | C | D | E | F | G | H | I | J | K | L |
| DONE PAINTING RED | NO | | | | | | | | | | | | |
| CLEAN INSIDE & OUTSIDE OF BELL | YES/NO | | | ON | | | | | ON | ON | ON | | |
| CLEAN SHROUD | YES | VALVE POSITION N/A (CAN BE PARALLEL PROCESS) | | | | | | | | | | | |
| PRIME LINES WITH RED | YES | ON | ON | | ON | | ON | | | | | ON | ON |
| FILL CAN WITH RED | YES | | ON | | ON | | | | | | | ON | ON |
| CLEAN & DRY DOCKING INTERFACE | YES | | | ON | ON | ON | | | | | ON | | ON |
| CONTINUE DRYING | NO | | | ON | ON | ON | | | | | ON | | |
| PAINT WITH RED | NO | ON | | | | | | | | | | | |

ELECTROSTATIC PAINTING APPARATUS WITH PAINT FILLING STATION AND METHOD FOR OPERATING SAME

CROSS-REFERENCE TO RELATED APPLICATIONS

This application claims the benefit of U.S. provisional patent application Ser. No. 60/251,686, filed Dec. 7, 2000, and U.S. provisional patent application Ser. No. 60/291,232, filed May 16, 2001.

BACKGROUND OF THE INVENTION

The present invention relates generally to robotic paint applicators and, particularly to an apparatus for changing the paint color for a waterborne bell applicator.

Robotic paint applicators for assembly lines are well known in the art. In order to be most efficient on a vehicle assembly line, for example, the robotic paint applicators must be able to paint with a variety of different colors changing as the objects to be painted are presented. A problem found in the prior art waterborne paint bell applicators when changing paint colors was a high cycle time. Cycle time is the amount of time needed to change from a current paint color to a new paint color, measured from the time the applicator stops painting with the paint color currently being applied to the time it starts painting with a different paint color. During this cycle time, the high voltage power supply must be disconnected, the internal passages and the external shroud of the bell applicator must be cleaned and the applicator must be connected with a source of the new paint color. Prior art applicators accomplished the color change by either switching connections between separate remote storage tanks for the current color paint and the new color paint, swapping an on board canister of the current color paint for a substitute canister filled with the new color paint, or cleaning the current color paint from the on board canister and filling it with the new color paint.

The U.S. Pat. No. 4,785,760 shows a sprayer installation having a paint sprayer carried by a robot with an arm for spraying objects carried by a conveyor. Circuits for distributing products to be sprayed each have first connection means at fixed locations within the range of the robot. A storage tank connected to the sprayer is carried by the robot and communicates with a first complementary connection means. The first complementary connection means is co-operable with the first connection means of any of the distribution circuits during which time the high voltage is turned off. The storage tank can be retained on the arm or can be exchanged for a filled tank at the first connection means.

The U.S. Pat. No. 5,772,125 shows a machine for spraying a coating material which machine includes a sprayer, an on-board supply tank having first connection means, a coating material changing assembly having second connection means, and a mobile subassembly carrying the sprayer, the supply tank and the changing assembly. At least one of the connection means is movable between a coupling position and an isolated position relative to the other connection means.

The art continues to seek improvements in reducing both the cycle time and in the amount of wasted paint during a color change operation. Reducing the cycle time increases both painting capacity and production capacity because more objects can be painted in a given amount of time. Reducing the amount of paint used by the robotic paint applicator represents an obvious cost savings.

SUMMARY OF THE INVENTION

The present invention concerns a bell applicator for reducing a cycle time for refilling or changing a paint color.

The bell applicator according to the present invention accomplishes this by combining some of the necessary steps in the cycle time. First, the paint applicator internals are cleaned while the applicator is en route to filling station. After the applicator arrives at the filling station, the external shroud is cleaned at the same time that the canister is being refilled with a new paint color.

The bell applicator according to the present invention also reduces the amount of wasted/excess paint that is common in the prior art applicators. The bell applicator according to the present invention is fed by an internal canister and is carried on the robot wrist. The applicator docks with a paint filling station that can supply multiple colors and is mounted either on the robot carriage or turret and thus moves with the robot, or at a fixed location in the booth within the reach of the robot.

The filling station has a plurality of paint injectors, one for each color, that can be selectively moved to a docking position to engage a paint receptacle on the applicator. The bell applicator external shroud can be washed while the canister is being filled. This color change approach offers cycle time and paint savings. The design alternative of using the robot to position the applicator to engage with a fixed injector is less favorable due to limitations of the robot reach and dexterity while rotating a typical 60-degree bell applicator in a filling station.

The bell applicator according to the present invention also incorporates provisions onboard the robot to clean the internal paint supply components including the canister, the cup and the distributor. An automatic valve mounted on the robot is designed to alternately control the supply of cleaning fluids to the uncharged bell or electrically isolate supply and dump lines from a charged bell. The bell can be cleaned en-route to the filling station thus reducing cycle time.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 9 is a table of the operating sequence of the voltage block and color change apparatus according to the present invention;

FIG. 12 is a cross-sectional view of a prior art bell applicator and FIG. 12A is an enlarged portion of FIG. 12;

FIG. 13 is a cross-sectional view of the bell applicator shown in FIG. 1 and FIG. 13A is an enlarged portion of FIG. 13;

FIG. 17 is a table of the operating sequence of the fluid circuits shown in FIG. 16 during a paint color change;

FIG. 18 is a table of the operating sequence of the fluid circuits shown in FIG. 16 during a refill of the same color paint;

DESCRIPTION OF THE PREFERRED EMBODIMENT

Figure 1:
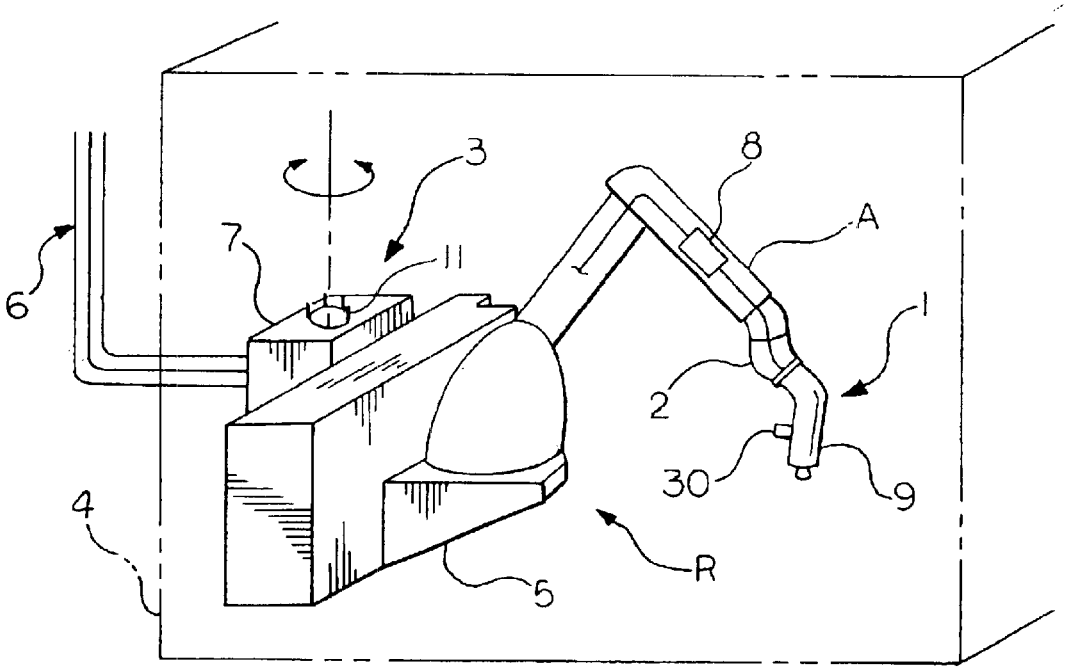
FIG. 1 is a perspective view of a bell applicator painting robot having a voltage block and color change apparatus in accordance with the present invention.

FIG. 1 shows a painting robot R having a bell applicator 1 mounted on a robot wrist 2 attached at an end of an arm A of the robot. The robot R can move the arm A to place the applicator 1 inside a filling or docking station 3 that is either fixed in a paint booth 4 or mounted on a carriage 5 of the robot. Multiple paint supply lines 6 feed paint of various colors from storage tanks (not shown) to the filling station 3 and the lines can be selectively connected to fill a paint canister in the arm A. The filling station 3 includes a shroud washer 7 that can function as the canister is filled. A fluid control valve 8 mounted on the robot arm A allows the internal paint passages of the bell applicator 1 to be cleaned as the robot R moves from a painting position toward the filling station 3 to align a shroud of the bell applicator 1 with the shroud washer 7. The filling station 3 includes a plurality of paint injectors 11 each connected to an associated one of the paint supply lines 6 for selectively coupling with a bell manifold 30 on the bell applicator 1 for filling the paint canister as described below.

Figure 2:
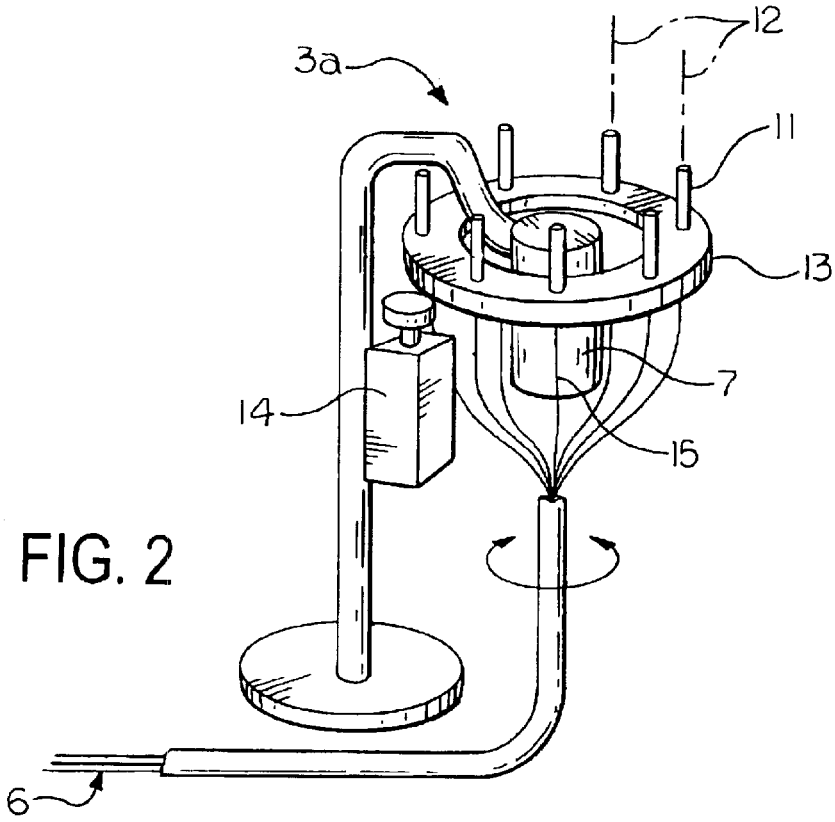
FIG. 2 is a perspective view of a first embodiment filling station for use with the apparatus shown in FIG. 1.

A rotary version of the filling station 3 is shown in more detail in FIG. 2. A first embodiment filling station 3*a* fills the canister of the bell applicator 1 with paint of a desired color and washes the shroud 9. The multiple paint supply lines 6 deliver several colors of paint to the filling station 3*a*. Each of the supply lines 6 is connected to an associated one of a plurality of paint injectors 11 arranged in a circular pattern with their engagement axes 12 aligned parallel to each other. The injectors 11 extend upwardly from an upper surface of an annular manifold turntable 13. The injectors 11 are centered about a vertical axis of rotation of the turntable 13 that is driven in rotation by a rotary indexing means 14. The shroud washer 7 is centered under the turntable 13 such that the robot R can position the shroud 9 in the washer 7 while simultaneously engaging a paint receptacle of the bell manifold 30 (FIG. 1) of the bell applicator 1 with a selected one of the paint injectors 11 that has been rotated to a docking position. The paint supply lines 6 are routed into a single bundle that twists about a rotational axis 15 of the turntable 13.

Figure 3:
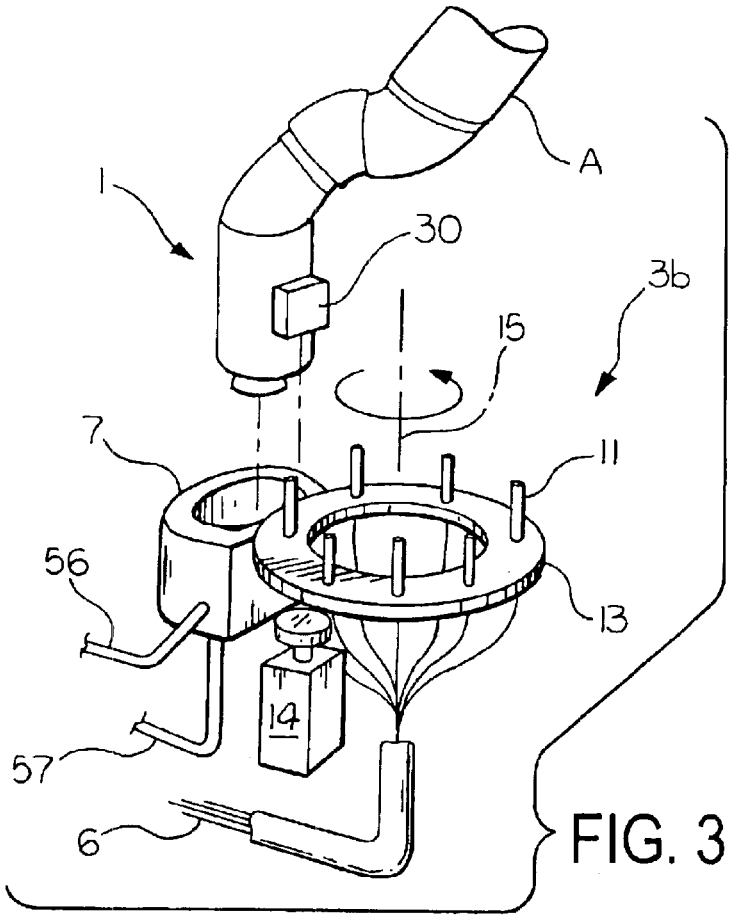
FIG. 3 is a perspective view of a second embodiment filling station for use with the apparatus shown in FIG. 1.

An alternate offset rotary arrangement of the injectors 11 is shown in FIG. 3. A second embodiment filling station 3*b* has the rotational axis 15 of the turntable 13 offset from an engagement axis 10 of the bell applicator 1 with the shroud washer 7. This arrangement provides a clear routing path for a shroud washer fluid supply line 56 and a drain line 57 that does not interfere with the paint supply lines 6 as they twist. The paint supply lines 6 can be routed more compactly since the enclosure of the washer 7 does not occupy the same space.

Figure 4:
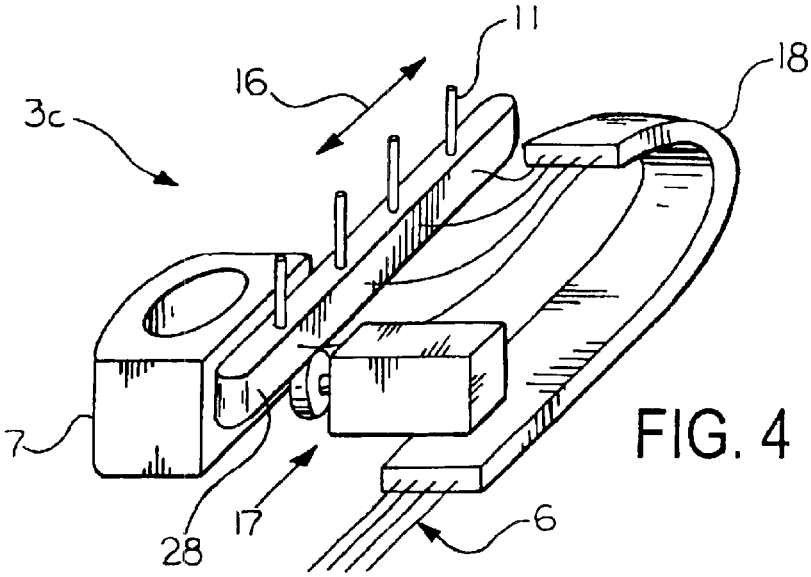
FIG. 4 is perspective view of a third embodiment filling station for use with the apparatus shown in FIG. 1.

Another or third embodiment filling station 3*c* is shown in FIG. 4. A linear arrangement of the injectors 11 is possible for movement along a straight path as indicated by a double-headed arrow 16. The injectors 11 extend upwardly from an upper surface of a linear manifold 28. A corresponding linear indexing means 17 drives the manifold 28 to position the selected injector 11 at a docking location. This arrangement retains the single shroud washer 7 at the docking location and may provide for a more compact and reliable routing of the paint supply lines 6 within a linear cable track 18.

Figure 6:
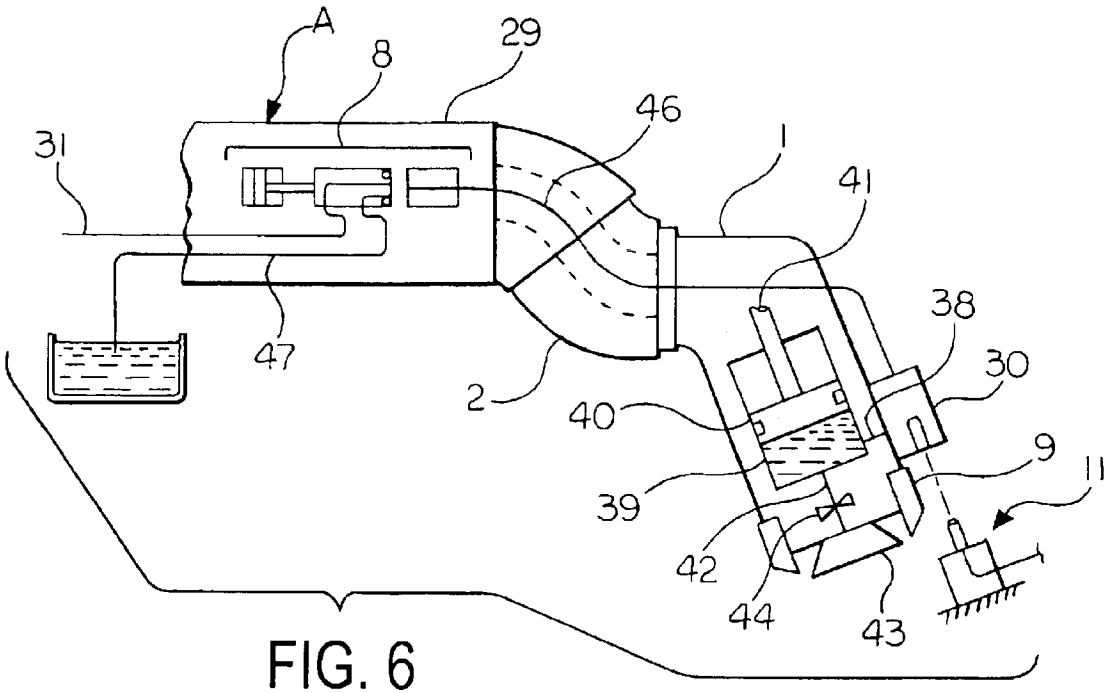
FIG. 6 is a schematic cross-sectional view of the robot arm with bell applicator and the paint injector shown in FIG. 1.
Figure 5:
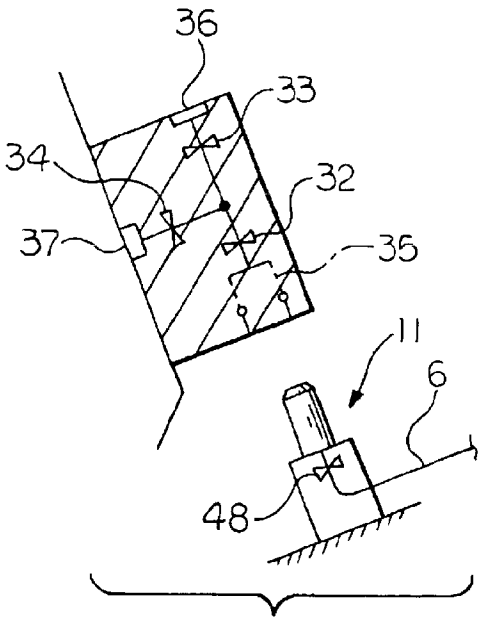
FIG. 5 is an enlarged schematic cross-sectional view of the manifold and paint injector shown in FIG. 1.
Figure 7:
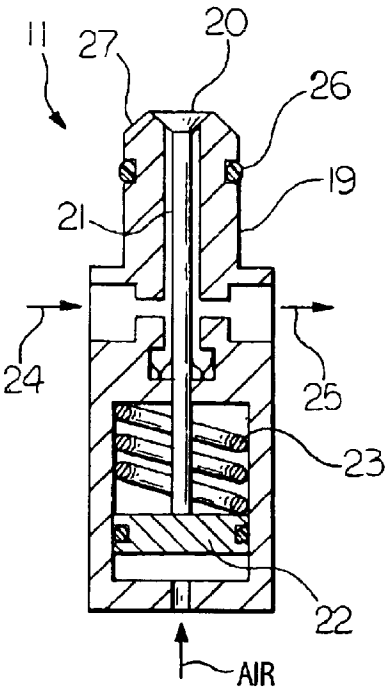
FIG. 7 is an enlarged cross-sectional view of the paint injector shown in FIG. 5.

As shown in FIGS. 5 and 6, the injectors 11 are designed to mate with a receptacle 35 formed in the bell manifold 30 mounted on an exterior surface of the bell applicator 1. The injector 11 is shown in more detail in FIG. 7 and has a hollow valve body 19 with a seat 20 formed at an upper end of a central stem 21 to function as a valve. The valve is opened by supplying air pressure to a lower surface of a pilot piston 22 attached to a lower end of the stem 21. A spring 23 abuts an upper surface of the piston 22 to close the valve when the air pressure is removed. Radially extending supply port 24 and return port 25 allow unused paint to re-circulate in the supply lines 6. A face or radial seal 26 on the exterior surface of the body 19 mates with the wall of the bell applicator paint receptacle 35. A piloting surface 27 formed on the upper end of the valve body 19 engages with a corresponding surface (not shown) of the paint receptacle 35 to align mating components during the docking process. A small burst of solvent and air can be directed from the bell applicator 1 to clean exposed surfaces of the receptacle 35 and the injector 11 as they disengage upon completion of the fill cycle.

As shown in FIG. 6, the fluid control valve 8 is mounted inside a section 29 of the robot arm A and is connected by a flexible fluid line 46 to the bell manifold 30 mounted on the bell applicator 1. The valve 8 controls the flow of cleaning fluids to the manifold 30 and can electrically isolate charged fluid on an output side connected a fluid supply line 31 and an input side connected to a dump line 47. The manifold 30 includes pilot operated valves 32, 33 and 34 (FIG. 5) connected between a common point and the paint receptacle 35, an inlet port 36, and an outlet port 37 respectively. A first short passage 38 (FIG. 6) connects the outlet port 37 with a fluid side of a canister 39 that contains a piston 40 and a drive means 41 for the piston. A second short passage 42 connects the fluid side of the canister 39 to a bell cup 43 of the bell applicator 1. A trigger valve 44 controls the flow of fluid through the passage 42 from the canister 39 to the bell cup 43. The shroud 9 surrounds the bell cup 43 and houses shaping air components (not shown). The bell applicator 1 can be docked to one of the paint supply lines 6 controlled by a pilot operated injector valve 48.

Figure 8:
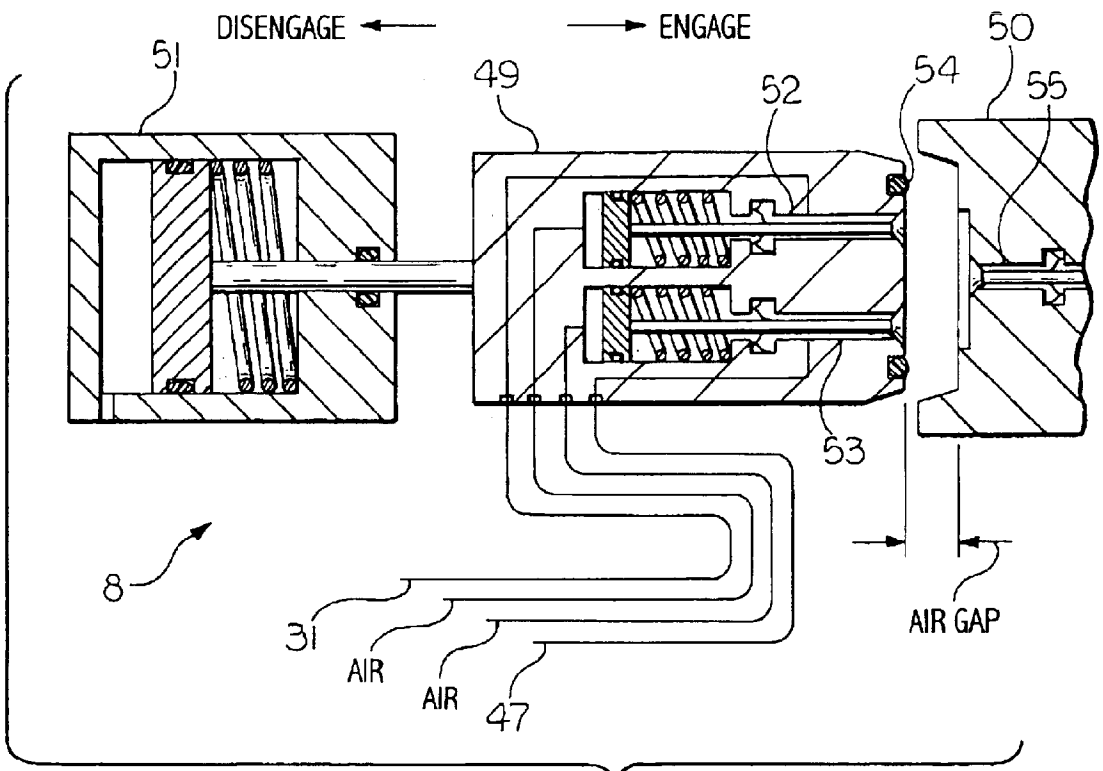
FIG. 8 is a cross-sectional view of the fluid control valve shown in FIG. 6.

As shown in FIG. 8, the fluid control valve 8 has a moving portion 49, a stationary portion 50, and a linear actuation means 51 for reciprocating the portion 49 relative to the portion 50. The moving portion 49 includes a supply stem valve 52 and a dump stem valve 53 that feed into a common axial surface surrounded by a face seal 54. The stationary portion 50 has a stem valve 55 that can block the flow of cleaning fluids out to the bell applicator 1 and allow the mating face of the two ports 49 and 50 to be cleaned prior to disengaging the fluid control valve 8. An air gap is created between the facing surfaces of the portions 49 and 50 when the valve is disengaged. This air gap insulates the cleaning fluid supply and dump lines from high voltage that is applied to the bell applicator 1 when paint is dispensed. Each of the stem valves 52, 53 and 55 is air-actuated and spring closed. As a design option, a paint stem valve (not shown) can be added to the moving portion 50 for purposes of supplying paint. The paint stem valve would feed into the common axial surface shared by the other stem valves.

FIG. 9 is a table showing the states of various components of the voltage block and color change apparatus according to the present invention during the clean and fill operation that incorporates the following steps:

a) Painting is completed with green paint.

b) The internal paint supply components and the bell cup are cleaned and the desired paint injector is indexed into position all while the robot is en-route to the filling station. A small amount of cleaning fluid is flushed out the bell cup while the piston is agitated up/down near the end of its stroke.

c) The bell applicator docks with the red paint supply line (the paint receptacle engages with red paint injector).

d) A small amount of red paint is fed to the bell cup with the piston bottomed out.

e) The canister fills with red paint.

f) As the bell applicator releases from the docking station, a small amount of cleaning fluid is ported from the bell applicator to clean the paint receptacle and the injector.

g) The face of the fluid control valve is cleaned and disengaged (block voltage).

h) The robot paints with red paint.

Figure 10:
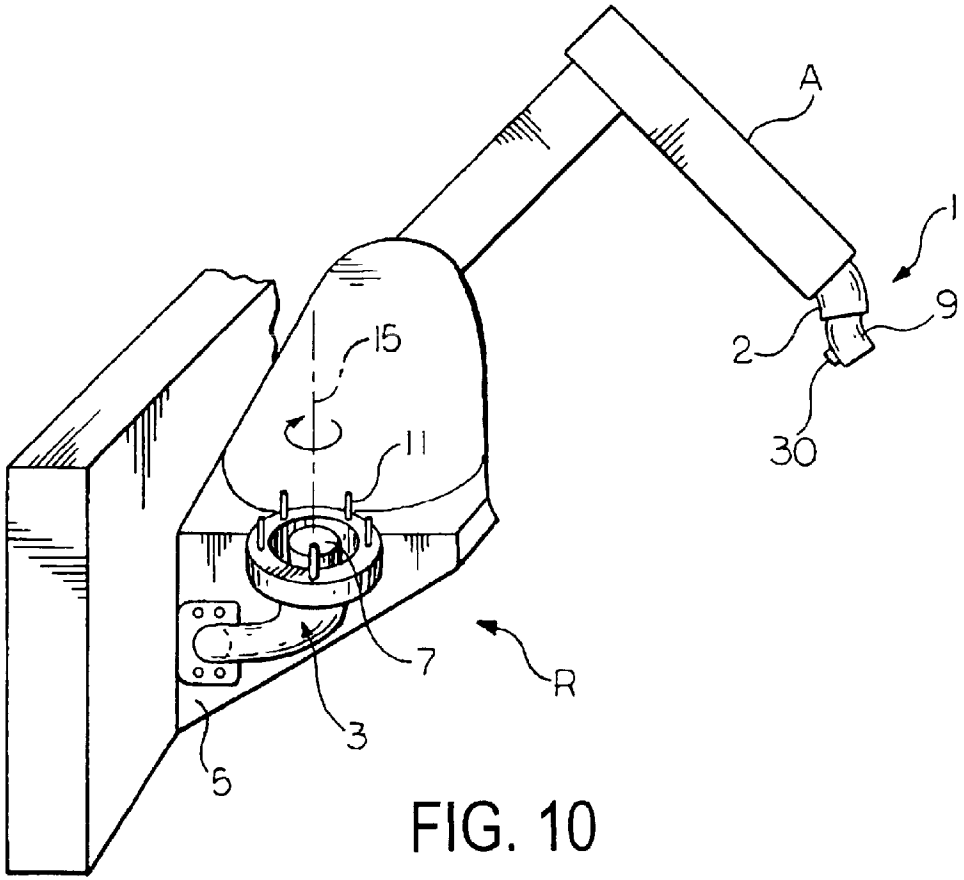
FIG. 10 is a perspective view similar to FIG. 1 showing an alternate mounting location for the voltage block and color change apparatus in accordance with the present invention.

FIG. 10 shows the painting robot R with the bell applicator 1 mounted on the robot wrist 2 attached at an end of the arm A as depicted in FIG. 1. However, a filling station 3' is shown mounted in an alternate location on the carriage 5 of the robot. The filling station 3' includes the plurality of paint injectors 11 for selectively coupling with the manifold 30 on the bell applicator 1 for filling the paint canister 39 as described above.

Figure 11:
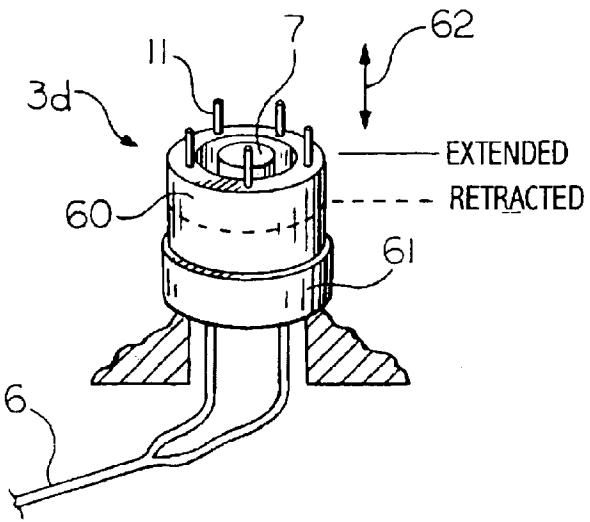
FIG. 11 is perspective view of a fourth embodiment filling station for use with the apparatus shown in FIG. 1.

A fourth alternate embodiment filling station **3*d* is shown in FIG. 11. The injectors 11 extend upwardly from an upper surface of a tubular manifold 60 surrounding the shroud washer 7. The manifold 60 is mounted on a base 61 for up and down movement as indicated by a double-headed arrow 62. In an extended position as shown in FIG. 11, the selected injector 11 couples with the bell manifold 30 for filling the canister 39. In a retracted position shown in dashed line, the injectors 11 are somewhat protected against overspray and physical damage from collisions with the robot arm. In this embodiment, the bell applicator 1 positions the manifold 30 over the selected one of the injectors 11**.

There is shown in FIG. 12 a prior art bell applicator 65 mounted on a wrist 66 of a robot arm 67. The applicator 65 houses an electric servomotor 68 driving a ball screw 69 that pushes a piston 70 of a paint canister 71. The prior art bell applicator 65 has several shortcomings. The electric servomotor 68 and attached cabling 72 are potential ignition sources within the hazardous environment of a paint booth. Provisions must be made to isolate the motor 68 and the cabling 72 from the hazardous environment. Explosion proof motors are costly due to a sealed and pressurized enclosure 73 that is required. It is difficult to provide a safe and reliable routing for the electric cable bundle 72 that must flex with the wrist articulation. The cable that passes through the confined space of the hollow wrist 66 is subjected to complex bending and torsion. Cable construction that is approved for hazardous environment is not safe for use under these flexing conditions. Placing the cable 72 inside a pressurized nylon tube 74 (FIG. 12A) increases its overall diameter and stiffness making it difficult to route through the hollow wrist 66.

It is desirable to minimize the mass and package size of equipment mounted on a robot wrist to reduce the required load capacity of the robot arms and drives and to avoid interference with the work piece and the environment. The prior art electric servomotor 68 packaged at the wrist 66 adds payload to the robot and consumes valuable interior space. The apparatus according to the present invention overcomes these shortcomings.

As shown in FIG. 13, an electric servomotor 80 is located in a robot arm 81 such that it is not part of and does not move with a bell applicator 82 that is attached to a robot wrist 83. Rotary motion and torque is delivered from the motor 80 to the bell applicator 82 by a flexible rotary shaft 84 extending through the arm 81. The shaft 84 flexes to accommodate the wrist axes motion and can be routed through the inside of the hollow wrist 83. An outer casing 85 of the flexible shaft 84 is bearing 86 mounted to an applicator support housing 87 so that the casing 85 does not twist as a wrist face plate 88 rotates. The motor 80 can be located such that the flexible rotary shaft 84 accommodates the motion of any number of robot arm and wrist axes.

The motor 80 can be positioned inside an existing pressurized enclosure 89 that houses other motors used to drive the robot axes. Using a common enclosure reduces cost. Alternatively, the motor 80 can be located outside the paint booth. Breakage of the grounded flexible rotary shaft 84 is not considered a potential ignition source within the hazardous paint booth environment. Eliminating the motor 80 from the paint applicator assembly reduces the mass and size of the wrist mounted applicator 82 resulting in reduced cost and avoiding electrical cables flexing through the wrist 83.

Figure 14:
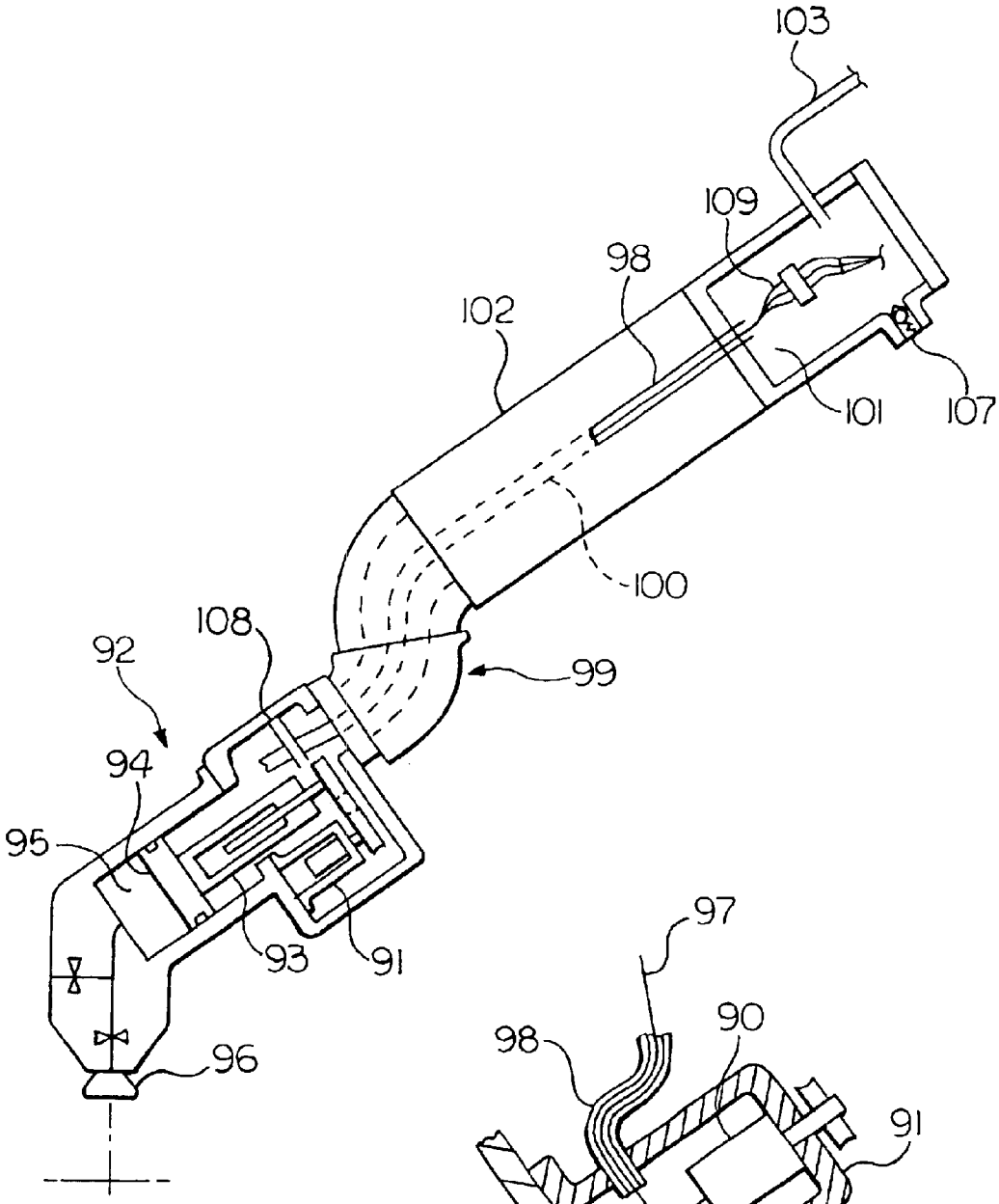
FIG. 14 is a cross-sectional view of a robot arm and bell applicator according to the present invention.
Figure 15:
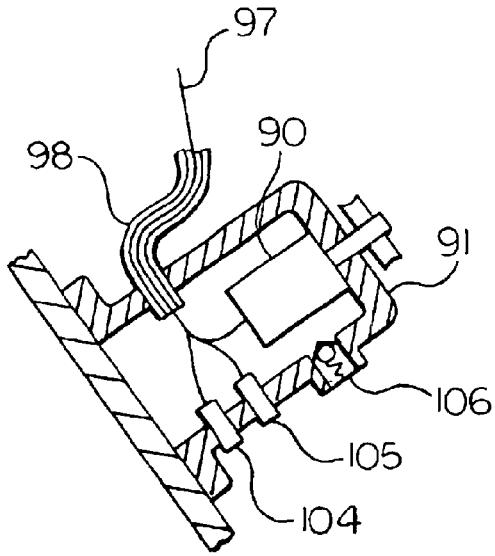
FIG. 15 is an enlarged cross-sectional view of the canister servomotor and enclosure shown in FIG. 14.

Another embodiment of the bell applicator according to the present invention is shown in FIGS. 14 and 15 wherein the motor is mounted in an enclosure in the bell applicator and motor wires are placed within sealed and air pressurized nylon tubing as they flex through the robot wrist. A miniaturized purge system with control hardware is placed inside the motor enclosure. An electric servomotor 90 is mounted inside a sealed enclosure 91 on a bell applicator 92 and drives a ball screw assembly 93 that pushes on a piston 94 in a canister 95 to dispense paint to a rotating bell cup 96. Electric wires 97 connected to the motor 90 are routed inside nylon tubes 98 that flex through a robot wrist 99 along with other service lines that comprise an applicator bundle 100. One end of each of the nylon tubes 98 is in fluidic connection with the motor enclosure 91. The other end of each of the tubes 98 is in fluidic connection with an enclosed portion 101 of a robot arm structure 102. The tubes 98 and the enclosures 91 and 101 are fed pressurized air from an air supply 103 that connects to the arm structure 102. This arrangement keeps the motor 90, the wires 97 and associated connections separated from the hazardous spray booth environment.

A purge pressure switch 104 and a maintenance pressure switch 105 are mounted inside the motor enclosure 91 to sense pressure relative to atmosphere. A purge pressure relief valve 106 is mounted in the motor enclosure 91 and a safety pressure relief valve 107 is mounted in the enclosed portion 101. The purge pressure relief valve 106 cracks open to allow a predetermined amount of fresh air from the air supply 103 to purge the sealed environment. The purge pressure switch 104 confirms internal pressure is above the cracking pressure of the purge relief valve 106. The maintenance pressure switch 105 detects a nominal internal pressure required to prevent the hazardous spray booth environment from entering the sealed environment. The safety relief valve 107 cracks to protect the sealed environment from an overpressure condition.

A clamp 108 rigidly clamps the bundle 100 to the bell applicator 92 near the robot wrist 99. The clamp 108 is designed to cluster the bundle lines around a common axis to minimize the motion and strain on the lines. The clamp 108 isolates the connection end of the bundle lines at the applicator 92 from the loads generated as the bundle 100 flexes through the wrist joint 99. Insulation displacing connectors 109 are used at the arm end of the wires 97 routed inside the nylon tubes 98. This allows for quick replacement of the flexing wires 97.

Figure 16:
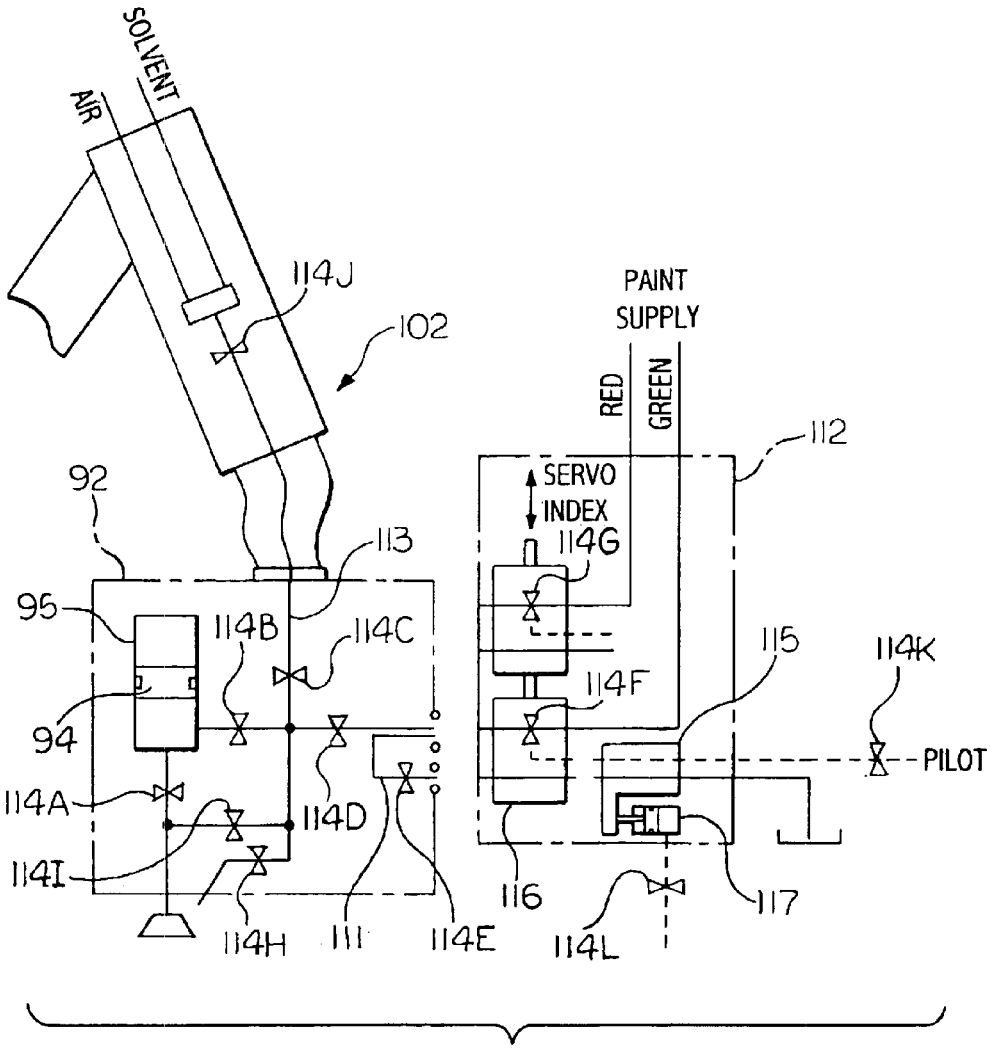
FIG. 16 is a schematic of the fluid circuits of the bell applicator shown in FIG. 14 and an associated docking station.

The voltage block and color change apparatus according to the present invention includes an improved filling or docking station and operating sequence as shown in FIGS. 16–18. The apparatus includes such improvements as: a shortened on-arm cleaning circuit that can be quickly dried to provide voltage block; a dual "V-shape" injector stack that reduces docking station size; a single solenoid actuated air pilot valve that controls all paint injector valves; and a fail safe design to protect against inadvertently opening an injector.

As shown in FIG. 16, the bell applicator 92 includes a cleaning fluid dump line 111 that is routed directly into a filling or docking station 112 instead of back through the robot arm 102. This shortens the length of line exposed to high voltage during painting. Tests indicate that a remaining fluid supply line 113 can be dried in an acceptably short time period to achieve sufficient voltage isolation from the grounded robot arm structure 102.

The bell applicator and docking station fluid circuits shown in FIG. 16 include a plurality of valves 114A through 114L. A single solenoid actuated air pilot valve 114K in the docking station 112 is used to actuate a row of paint injector valves with only two such valves 114F and 114G being shown. Air pilot pressure is ported through the valve 114K to the selected injector from a common supply manifold 115 that docks to the rear of an injector manifold 116. The pilot pressure opens the selected injector valve 114F. The sequence of operation is as follows:

1. A firing cylinder 117 pushes the supply manifold 115 to engage with the injector manifold 116.

2. The firing cylinder 117 continues to extend until the injector manifold 116 engages with the bell applicator 92.

3. The remotely located air pilot valve 114K opens to provide pilot pressure to the injector valve 114F.

4. The injector valve 114F opens and paint is fed into the bell applicator 92.

The operation of the valves 114A through 114L is set forth in a table of FIG. 17 for a paint color change. The operation of the valves 114A through 114L is set forth in a table of FIG. 18 for refilling the canister 95 with the same color paint.

Figure 19:
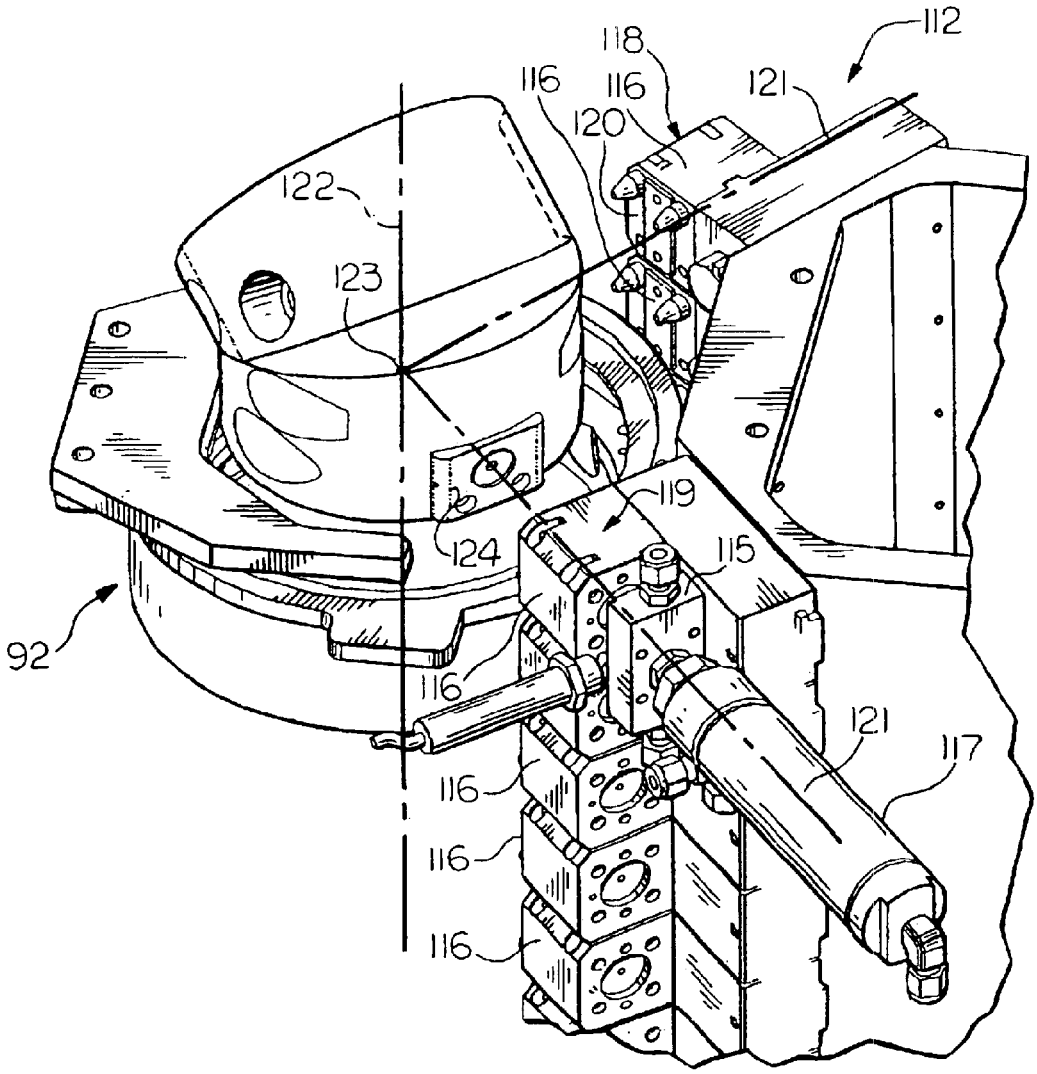
FIG. 19 is a perspective view of the bell applicator shown in FIG. 14 with a fifth embodiment filling station.

FIG. 19 is a perspective view of the bell applicator 92 in a docking position at the docking station 112. The station 112 is formed by two vertical rows, a left row 118 and a right row 119, of stacked injector manifolds 116 in a V-shaped configuration on a support frame. Each of the injectors 116 has an interface surface 120 and an interface axis 121 perpendicular thereto. The two rows 118 and 119 of the paint injectors 116 are oriented such that each injector 116 in one row lies in a common horizontal plane with a corresponding injector 116 of the other row. The interface axes 121 of the two injectors 116 in a common plane intersect a vertical shroud cleaner axis 122 at a common point 123. This arrangement allows the bell applicator 92 to be centered in the shroud cleaner (not shown) while docked with either row 118 and 119 of the paint injectors 116. If, for example, the bell applicator 92 is to be docked with the uppermost injector 116 in the right row 119, the right row is positioned to align the interface axis 121 with the point 123 as shown in FIG. 19. The bell applicator 92 has a docking surface and paint receptacle 124 that is oriented towards the right row 119 into alignment with the interface axis 121. The firing cylinder 117 associated with the right bank 119 is actuated to push the uppermost paint injector 116 towards the surface/receptacle 124. This design arrangement reduces the height of the docking station 112 by a factor of two (two rows of injectors versus one row per FIG. 4) while retaining a common shroud cleaner.

Figure 20:
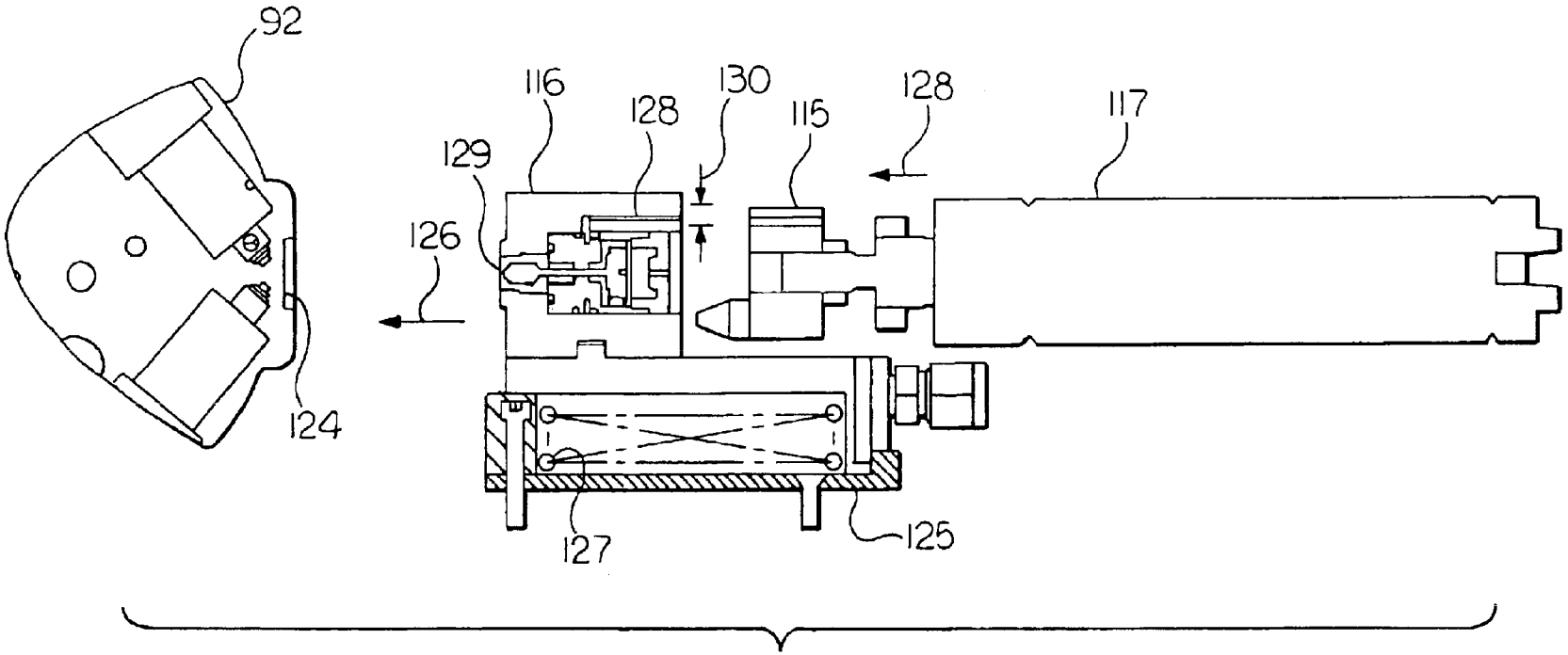
FIG. 20 is a cross-sectional view of one of the injectors shown in FIG. 19 with the bell applicator in a docking position.

As shown in FIG. 20, each of the injector manifolds 116 is mounted on a linear slide 125. The injector manifold 116 is pneumatically pushed towards the bell applicator 92 in a direction indicated by an arrow 126 against a return spring 127. This action is carried out by actuation of the firing cylinder 117 to move the supply manifold 115 in a direction of an arrow 127 into engagement with the injector 116 and move both toward the bell applicator 92. Should the bell applicator 92 not be present at the docking position and the absence of the applicator is not detected and the actuation sequence initiated, then pilot pressure in a passage 128 connected to an injector valve 129 will push the injector manifold 116 off of engagement with the supply manifold 115 and insufficient pilot pressure will be available to open the paint injector valve 129. Return spring force, travel limits of the firing cylinder 117, and a contact pressure area 130 on the injector manifold 116 are optimized to achieve this result. This feature prevents paint from the supply from unintentionally spraying out the injector 116 into the booth.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An electrostatic painting apparatus comprising:

a bell applicator having a paint receptacle and being movable to and from a docking position;

a paint canister in said bell applicator connected to said paint receptacle;

a paint filling station, said bell applicator being movable relative to said filling station; and at least two paint injectors attached to said filling station, each of said paint injectors being adapted to be connected to a different color paint, said filling station being actuatable to move each of said paint injectors selectively to the docking position along a docking axis for engagement with said paint receptacle for filling said paint canister with paint, said paint injectors begin mounted in two rows facing a common axis and the docking position is on the common axis.

2. The apparatus according to claim 1 wherein said paint injectors are each mounted for reciprocating movement along an associated interface axis to and from the docking position.

3. The apparatus according to claim 1 including a fluid control valve connected to said paint receptacle, said valve having a stationary portion and a moving portion, said stationary and moving portions being engaged for supplying cleaning fluid to clean said paint receptacle and being disengaged for providing voltage block protection during a painting operation of said bell applicator.

4. The apparatus according to claim 1 further composing:

said paint canister containing a piston slidably disposed in a cylinder for receiving and dispensing paint;

a robot wrist attached to said bell applicator;

a robot arm attached to said robot wrist; and a means for moving said piston in said cylinder to dispense paint from said cylinder and to refill said cylinder with paint, said means for moving being remotely located from said bell applicator and said robot wrist and being coupled to said piston by a flexible rotary shaft.

5. The apparatus according to claim 4 wherein said means for moving said piston includes a servomotor mounted in said robot arm and wherein said flexible rotary shaft extends from and is rotated by said servomotor, said shaft extending through said robot arm and said robot wrist to a ball screw driving said piston.

6. The apparatus according to claim 1 further comprising:

said paint canister containing a piston slidably disposed in a cylinder for receiving and dispensing paint;

a robot wrist attached to said bell applicator;

a robot arm attached to said robot wrist; and a servomotor for moving said piston in said cylinder to dispense paint from said cylinder and to refill said cylinder with paint, said servomotor disposed within a housing of said bell applicator and connected to an electrical wire bundle, said bundle having electrical wires disposed within at least one tube, said bundle extending from said servomotor through said robot wrist and through said robot arm and adapted to be connected to a power source, and said at least one tube and said housing being pressured.

7. The apparatus according to claim 6 including an air supply line connected to said robot arm for supplying pressured air to said housing through said at least one tube.

8. The apparatus according to claim 7 including at least one of a purge pressure switch mounted in said housing for measuring a pressure of the air in said housing and a maintenance pressure switch mounted in said housing for measuring a pressure of the air in said housing.

9. The apparatus according to claim 7 including at least one of a purge pressure relief valve mounted in said housing for allowing a predetermined amount of the air in said housing to purge outside said housing and a safety relief valve mounted in said arm to protect from an overpressure condition.

10. The apparatus according to claim 1 including a paint injector valve in each of said at least two paint injectors and means for sensing an absence of said bell applicator at the docking position to prevent opening of said paint injector valves.

11. The apparatus according to claim 1 wherein each of said at least two paint injectors is mounted on an associated slide movable on said filling station.

12. The apparatus according to claim 1 including a return spring for moving each said slide and said associated paint injector away from the docking position.

13. The apparatus according to claim 1 including a plurality of paint injectors mounted in two rows movable relative to the docking position, said rows forming a generally V-shaped assembly.

14. A voltage block and color change apparatus for a waterborne paint bell applicator comprising:

a bell applicator having a paint receptacle and being movable to and from a docking position;

a paint canister in said bell applicator connected to said paint receptacle;

a paint filling station;

at least two paint injectors movably attached to said filling station for individual movement toward and away from the docking position along an interface axis, said at least two paint injectors being selectively movable along a docking axis to align a selected one with the interface axis; and a firing cylinder actuatable to move said selected one paint injector along the interface axis to the docking position for engagement with said paint receptacle for filling said paint canister with paint.

15. The apparatus according to claim 14 including a paint injector valve in each of said at least two paint injectors and means for sensing an absence of said bell applicator at the docking position to prevent opening of said paint injector valves.

16. The apparatus according to claim 14 wherein each of said at least two paint injectors is mounted on an associated slide movable on said filling station.

17. The apparatus according to claim 16 including a return spring for moving each said slide and said associated paint injector away from the docking position.

18. The apparatus according to claim 14 including a plurality of paint injectors mounted in two rows movable relative to the docking position, said rows forming a generally V-shaped assembly.

19. A method of operating an electrostatic painting apparatus to fill a paint canister with paint comprising the steps of:

a) providing a bell applicator having a paint receptacle and a paint canister connected to the paint receptacle;

b) providing a paint filling station having at least two paint injectors attached to the filling station, each of the paint injectors being adapted to be connected to a different color paint;

c) moving the bell applicator to a fixed docking position adjacent the paint filling station; d) selecting one of the paint injectors and moving the one paint injector to the docking position along a docking axis for engagement with the paint receptacle for filling the paint canister with paint;

e) providing a shroud washer adjacent the docking position; and f) receiving the bell applicator in the shroud washer during said step c).

20. An electrostatic painting apparatus comprising:

a bell applicator;

a paint receptacle;

a paint canister connected to said paint receptacle for receiving paint through said paint receptacle;

a paint filling station, said paint receptacle being movable to and from a docking position adjacent said filling station; and at least two paint injectors attached to said filling station, each of said paint injectors being adapted to be connected to an associated different color paint supply, said filling station being actuatable to move each of said paint injectors selectively to the docking position along a docking axis and into engagement with said paint receptacle whereby when said paint receptacle is engaged with one of said paint injectors, paint can be transferred from the associated paint supply to said paint canister through said one of said paint injectors and said paint receptacle, and whereby said paint receptacle is disengaged from said one of said paint injectors before said paint receptacle is moved from the docking position.

21. The apparatus according to claim 20 wherein said paint injectors are mounted in a circular pattern spaced about a rotatable annular manifold and are rotated to the docking position.

22. The apparatus according to claim 20 wherein said paint injectors are mounted in a linear pattern on a manifold and are moved along a linear path to the docking position.

23. The apparatus according to claim 20 wherein a said paint injectors are included in a plurality of paint injectors mounted in at least two rows facing a common axis and the docking position is on the common axis.

24. The apparatus according to claim 23 wherein said paint injectors are each mounted for reciprocating movement along an associated interface axis to and from the docking position.

25. The apparatus according to claim 20 said paint injectors are mounted in a circular pattern spaced about an annular manifold and said manifold is movable toward and away from the docking position.

26. The apparatus according to claim 20 including a paint injector valve in each of said at least two paint injectors and means for sensing an absence of said bell applicator at the docking position to prevent opening of said paint injector valves.

27. The apparatus according to claim 20 wherein each of said at least two paint injectors is mounted on an associated slide movable on said falling station.

28. The apparatus according to claim 20 including a return spring for moving each said slide and said associated paint injector away from the docking position.

29. The apparatus according to claim 20 including a plurality of paint injectors mounted in two rows movable relative to the docking position, said rows forming a generally V-shaped assembly.

30. An electrostatic painting apparatus comprising:

a bell applicator having a paint receptacle and being movable to and from a docking position;

a paint canister connected to said paint receptacle for receiving paint through said paint receptacle;

a paint filling station having a shroud washer, said bell applicator being movable to and from a docking position, said bell applicator being received in said shroud washer in the docking position; and at least two paint injectors attached to said filling station, each of said paint injectors being adapted to be connected to an associated different color paint supply, said paint receptacle being selectively engagable with each of said paint injectors in the docking position whereby when said paint receptacle is engaged with one of said paint injectors, paint can be transferred from the associated paint supply to said paint canister through said one of said point injectors and said paint receptacle, and whereby said paint receptacle is disengaged from said one of said paint injectors before said bell applicator is moved from the docking position.

31. The apparatus according to claim 30 wherein said paint injectors are included in a plurality of paint injectors spaced about said shroud washer.

* * * * *